US009828121B2

(12) United States Patent
Zhang

(10) Patent No.: US 9,828,121 B2
(45) Date of Patent: Nov. 28, 2017

(54) SEALANT FILLING DEVICE

(71) Applicant: SHENZHEN CHINA STAR OPTOELECTRONICS TECHNOLOGY CO., LTD., Shenzhen, Guangdong (CN)

(72) Inventor: Longxian Zhang, Guangdong (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 14/413,155

(22) PCT Filed: Dec. 26, 2013

(86) PCT No.: PCT/CN2013/090605
§ 371 (c)(1),
(2) Date: Jan. 6, 2015

(87) PCT Pub. No.: WO2015/096110
PCT Pub. Date: Jul. 2, 2015

(65) Prior Publication Data

US 2016/0288934 A1 Oct. 6, 2016

(30) Foreign Application Priority Data

Dec. 23, 2013 (CN) ..... 2013 1 0719161

(51) Int. Cl.
*B65B 3/28* (2006.01)
*B65B 3/10* (2006.01)
(Continued)

(52) U.S. Cl.
CPC ..... *B65B 3/28* (2013.01); *B05C 11/1002* (2013.01); *B65B 3/04* (2013.01); *B65B 3/10* (2013.01); *B65B 3/26* (2013.01); *B65B 65/02* (2013.01)

(58) Field of Classification Search
CPC .. B65B 3/28; B65B 3/04; B65B 65/02; B05C 11/1002
(Continued)

(56) References Cited

U.S. PATENT DOCUMENTS 3,662,517 A * 5/1972 Tascher ..... A61M 5/00 53/282
4,373,560 A * 2/1983 Elsworth ..... B65B 3/32 137/625.19
(Continued)

FOREIGN PATENT DOCUMENTS

CN 1272056 A 11/2000
CN 1678406 A 10/2005
(Continued)

*Primary Examiner* — Timothy L Maust
*Assistant Examiner* — Timothy P Kelly

(57) ABSTRACT

A sealant filling device comprises a sealant board and a plurality of injectors installed on it, the sealant board comprises a base and a sealing cover which opening a plurality of sealing holes, the injector comprises a feeding hole which is opposite to the sealing holes, the sealant can be poured into the injector from the sealing holes to the feeding hole, a spring between the top of the injector and the sealing cover is provided for moving in control, while the volume of the sealant reaches the preset value, the spring will be control to move and seal off the sealing hole to stop sealing. If the volume of the sealant reaches the preset volume, then the controller IC will drive the spring moving and sealing off the sealing hole by controlling of the motor. The sealant volume in each injector can be separated distributed.

19 Claims, 3 Drawing Sheets

(51) Int. Cl.

| | |
|---|---|
| ***B65B 3/26*** | (2006.01) |
| ***B05C 11/10*** | (2006.01) |
| ***B65B 3/04*** | (2006.01) |
| ***B65B 65/02*** | (2006.01) |

(58) Field of Classification Search
USPC ..... 141/83, 95, 144, 234–236
See application file for complete search history.

(56) References Cited

U.S. PATENT DOCUMENTS

| | | | | |
|---|---|---|---|---|
| 2004/0182887 | A1 | 9/2004 | Sugimura et al. | |
| 2006/0201575 | A1* | 9/2006 | Osborne | B65B 7/2821 141/27 |
| 2012/0012224 | A1* | 1/2012 | Haeuslmann | B67C 3/202 141/1 |

FOREIGN PATENT DOCUMENTS

| | | | |
|---|---|---|---|
| CN | 101463775 | A | 10/2007 |
| CN | 202783835 | U | 3/2013 |
| CN | 203235647 | U | 10/2013 |

* cited by examiner

SEALANT FILLING DEVICE

FIELD OF THE INVENTION

The invention relates to a filing device, more particularly relates to a filling device for filling the sealant.

BACKGROUND OF THE INVENTION

Sealants can be poured into the several injectors from a filing hole of each injector in the same time and same speed. Actually, a coating length of each injector is different. So a sealant wastage in each injector is also different. The sealant wastage of two injectors in two opposite sides is more than that of in the middle. When the coating process is over, the sealants of two injectors in both two sides is exhausted and the sealants in the middle is remained. Then the unused sealants are wasted.

SUMMARY OF THE INVENTION

To overcome above disadvantages, a main purpose of the present invention is provided a sealant filling device which can preset and adjust the volume and automatically control a filing process to obtain a uniform coating.

The present invention provides a sealant filling device comprising a sealant board and a plurality of injectors installed on the sealant board. The sealant board comprises a base a sealing cover and a plurality of sealing holes defined in the sealing cover. The plurality of injector are clamped on the base, each of the plurality of injectors comprises a feeding hole which is opposite to the sealing holes. The sealant can be poured into the injector from the sealing holes to the feeding hole. A spring is arranged between a top of the injector and the sealing cover. While a volume of the sealant reaches a preset value, the spring is controlled to move and seal off the sealing hole to stop sealing.

In the preferred embodiment, a weight sensor is arranged on a bottom of the injector for measuring a sealant weight of the injector, and a height sensor is located at two sides of the injector for measuring if a height of the sealant reaches a highest preset value or not. The weight sensor is mounted under the packaging barrel.

In the preferred embodiment, the injector comprises a controller IC and a motor. The controller IC is electrically connected with the weight sensor and the motor, the motor is also electrically connected with the spring. The controller IC is provided for receiving a detection signal from the weight sensor and controlling the motor to drive the spring to move according to a compared result between the sealant weight and a standard value of the detection signal.

In the preferred embodiment, the controller IC is electrically connected with the height sensor and the motor. The motor is electrically connected with the spring. The controller IC is provided for receiving a detection signal from the height sensor and controlling the motor to drive the spring to move according to a compared result between the height of sealant and the highest preset value of the detection signal.

After detecting of the weight and the height of the sealant, a detecting result is acquired whether the volume of the sealant reaches the preset value or not. The spring can be adjusted to seal off the sealing hole by automatic controlling the motor. That is to say, the sealing process can be automatic controlled and the weight of the sealant in each injector can be separated preset. The weight of the sealant can be distributed basic on the necessary. If a consume of sealant in the side injector is much more than the middle injector, than the preset sealant in the side injector will be more that of in the middle injector. So after the sealant pouring, the sealant consume is balanced which in the side injector and the middle injector. As a result, the sealant will be not remained in any injector to be wasted.

In the preferred embodiment, the height sensor comprises a signal generator and a signal receiver in a same horizontal line, while the height of the injected sealant reaches the preset value, the signal receiver do not receive the signal from the signal generator, and the signal receiver sends a broken signal to the controller IC to drive the spring to move and seal off the sealing hole by controlling the motor. The signal source of the signal generator is an infrared ray. The signal generator and the signal receiver are separated placed on two sides of the injector, a distance between the signal generator and the injector is equal to that of between the signal receiver and the injector. A distance between the signal generator and a edge of the injector is 1.5-2 cm.

In the preferred embodiment, the spring can be adhered at a bottom of the sealing cover for preventing the sealant flowing out from the two side of the sealing holes. The sealing effect is better than before.

In the sealant filling device of the present invention, the spring is connected with the weigh sensor and the height sensor. The weight sensor is provided for determining the weight of the sealant in the injector. If the volume of the sealant reaches the preset volume, then the weight sensor or the height sensor will send a feedback signal to the controller IC to drive the spring to move and seal off the sealing hole by controlling of the motor. With automatically detecting the filling process, a moderate sealant will be filled into each injector. On the one hand, the sealant volume in each injector can be separated distributed, on the other hand, the filling precision and the degree of automation will be improved and the consume of the sealant will be reduced with automatically controlling the filling process.

DESCRIPTION OF THE PREFERRED EMBODIMENTS

Figure 1:
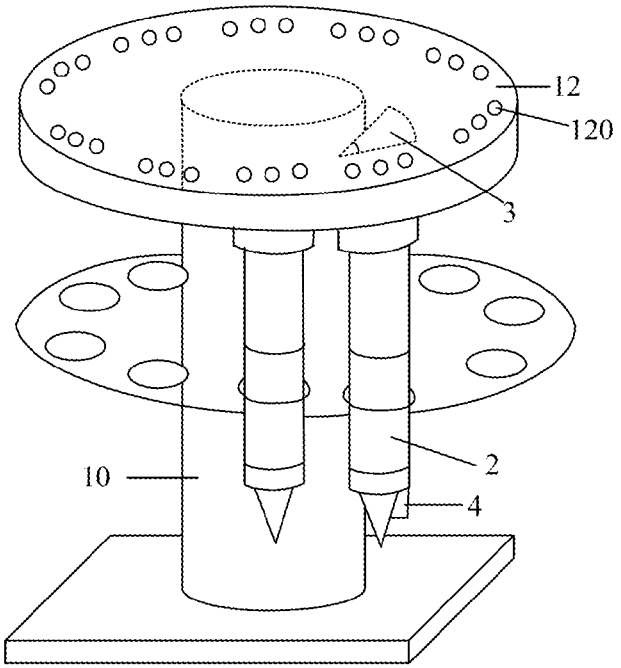
FIG. 1 is a schematic view of a sealant filling device according to the present invention.

The sealant filling device of the present invention is provided to solve the problems that the sealant volume and consumption of each sealant filing device are unbalance to make some sealant remained during synchronous pouring sealant process. The sealant filling device comprises a sealant board 1 and a plurality of injectors 2 installed on the sealant board 1. The sealant board 1 comprises a base 10 and a sealing cover 12 which defines a plurality of filing holes 120. The plurality of injectors 2 are clamped on the base 10. A feeding hole 200 of each injector 2 is arranged opposite to the sealing holes 120. The sealant can be poured into the injector 2 from the sealing holes 120 via the feeding hole 200. A spring 3 is arranged between a top of the plurality of injector 2 and the sealing cover 12. While a volume of the sealant reaches a preset value, the spring 3 is controlled to move and seal off the sealing hole 120 to stop sealing. Preferably, the spring 3 can be mounted on a bottom of the sealing cover 12 of the plurality of injector 2, so the sealant would not be flowed out from the injector to seal off the feeding hole 200 with the spring 3 closely contacts with the sealing cover 12.

The sealing cover 12 of the sealant board 1 is located on the base 10. The base 10 comprises a plurality of clampers for clamping bottoms of the injectors 2. The injectors 2 can be clamped to stand up. A top of the each of the injector 2 resists the sealing cover, and the top of each of the injector 2 opens a feeding hole 200 which is opposite to the sealing holes 120. The injector 2 comprises a top cover 20, a packaging barrel 22 and an injector head 24. A plurality of feeding holes 200 are defined on the top cover 20. The injector head 24 is mounted at a bottom of the packaging barrel 22. The sealant can be poured into the packaging barrel 22 from the feeding hole 200 and be poured out from the injector head 24. The sealant can be simultaneously poured out from the plurality of injectors 2.

Figure 2:
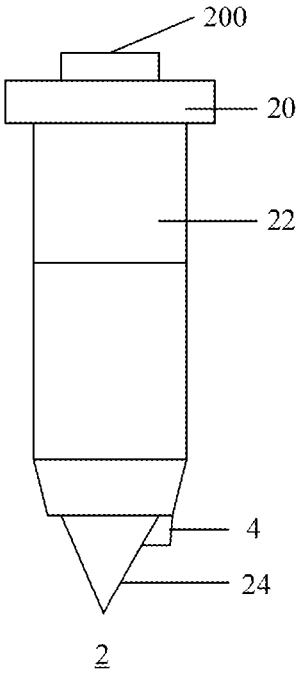
FIG. 2 is a schematic view of a sealant filling device in the first embodiment according to the present invention.
Figure 3:
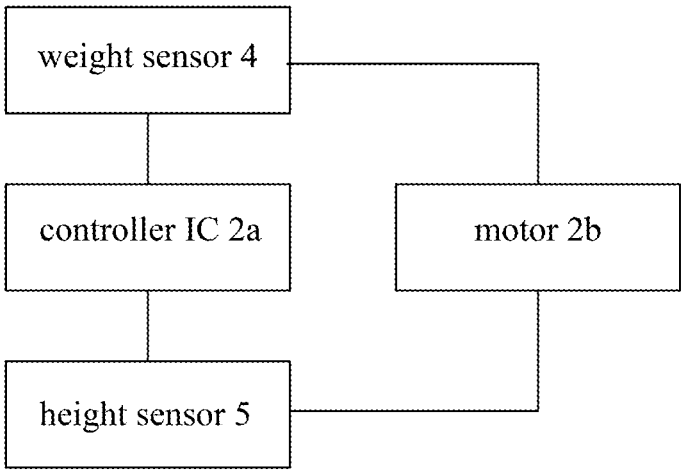
FIG. 3 is a circuitous philosophy view of a sealant filling device according to the present invention.

Referring to FIG. 2, in the first embodiment a weight sensor 4 is arranged on the bottom of the injector 2 for measuring a sealant weight of the injector 2 and determining whether the sealant weight reaches a preset weight or not. If the sealant weight reaches the preset weight, then the weight sensor 4 sends a feedback signal to the controller IC. Referring to FIG. 3, the injector 2 comprises a controller IC 2*a* and a motor 2*b*, the controller IC 2*a* is electrically connected with the weight sensor 4 and the motor 2*b*, the motor 2*b* is also electrically connected with the spring 3, the controller IC 2*a* is provided for receiving the feedback signal from the weight sensor 4 and driving the spring 3 to seal off the sealing hole 120 of the sealing cover 12. The spring 3 is driven by the motor 3.

Figure 4:
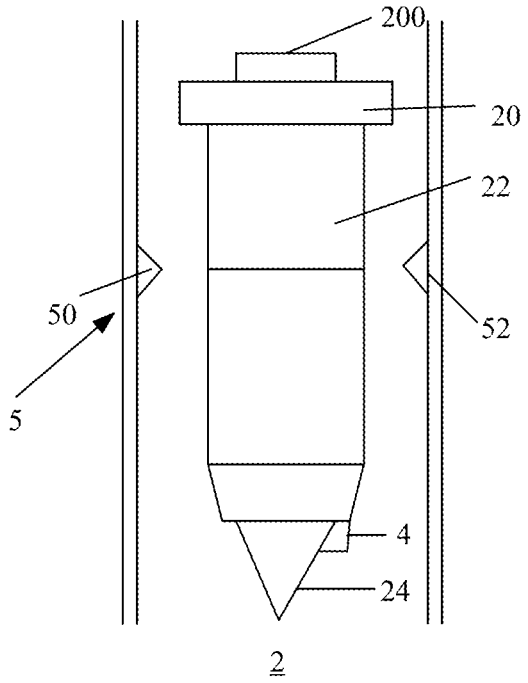
FIG. 4 is a schematic view of a sealant filling device in the second embodiment according to the present invention.
Figure 5:
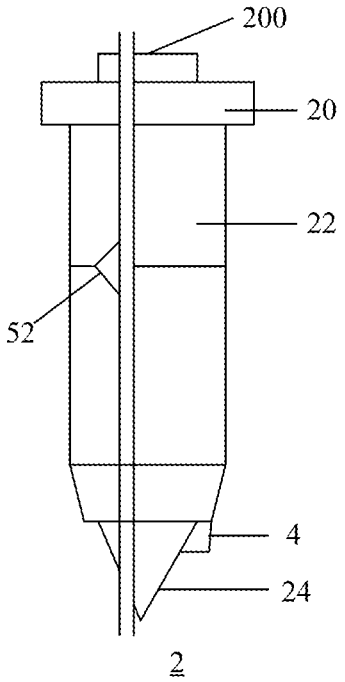
FIG. 5 is a side view of a sealant filling device in the second embodiment according to the present invention.

Referring to FIGS. 3-5, in the second embodiment, a height sensor 5 is located at the both sides of the injector 2 for measuring whether a height of the sealant reaches a highest preset value or not. The height sensor 5 comprises a signal generator 50 and a signal receiver 52 which are located in a same horizontal line, while the height of the injected sealant reaches the highest preset value, the signal receiver 52 can not receive the signal from the signal generator 50, and the signal receiver 52 will send a broken signal to the controller IC 2*a* to drive the spring 3 to seal off the sealing hole by controlling the motor. The signal generator 50 and the signal receiver 52 are separated placed on the both sides of the injector 2, a distance between the signal generator 50 and the injector 2 is equal to that of between the signal receiver 52 and the injector 2. A signal source of the signal generator 50 is an infrared ray. A distance between the signal generator 50 and the edge of the injector 2 is 1.5-2 cm.

A volume of the sealant can be figured out with the weight or the height of the sealant in the package barrel 22. When the sealant weight reaches the preset value, then the weight sensor 4 will send the feedback signal to the controller IC 2*a* to drive the spring 3 to seal off the sealing hole 120 of the sealing cover 12. Similarly, when the sealant height reaches the highest preset value, the signal receiver 52 can not receive the signal from the signal generator 50, and the signal receiver 52 will send a broken signal to the controller IC 2*a* to drive the spring 3 to seal off the sealing hole 120 by controlling the motor. Accordingly, the spring 3 can be controlled to move according to compared results between the sealant height and the highest preset value or the sealant weight and the preset value.

The sealant volume in each injector can be separated distributed. The sealant volume can be controlled with the weight sensor and the height sensor so as to precisely distribute the volume of the sealant. As a result, the filling precision and the degree of automation will be improved and the remaining and producing of the sealant will be reduced with automatically controlling the filling process.

What is claimed is:

1. A sealant filling device, comprising:

a sealant board having a base, a sealing cover, a plurality sealing holes defined in the sealing cover; and a plurality of injectors clamped in the base, each of the plurality of injectors having a filling hole corresponding to the sealing hole;

wherein a weight sensor is arranged on a bottom of the injector for measuring a sealant weight of the injector;

a height sensor is located at two sides of the injector for measuring if a height of the sealant reaches a highest preset value or not;

a spring is arranged between a top of the injector and the sealing cover, while the weight or the height of the sealant reach a preset value, the spring is controlled to move and seal off the sealing hole to stop sealing.

2. The sealant filling device according to claim 1, wherein the injector comprising a controller IC and a motor, the controller IC is electrically connected with the weight sensor and the motor, the motor is also electrically connected with the spring, the controller IC is provided for receiving a detection signal from the weight sensor and controlling the motor to drive the spring to move according to a compared result between the sealant weight and a standard value of the detection signal.

3. The sealant filling device according to claim 2, wherein the controller IC is electrically connected with the height sensor and the motor, and the motor is electrically connected with the spring, the controller IC is provided for receiving the detection signal from the height sensor and controlling the motor to drive the spring to move according to a compared result between the height of sealant and the highest preset value of the detection signal.

4. The sealant filling device according to claim 3, wherein the height sensor comprises a signal generator and a signal receiver in a same horizontal line, while the height of the injected sealant reaches the preset value, the signal receiver do not receive the signal from the signal generator, and the signal receiver sends a broken signal to the controller IC to drive the spring to move and seal off the sealing hole by controlling the motor.

5. The sealant filling device according to claim 4, wherein the signal generator and the signal receiver are separated placed on the two sides of the injector, a distance between the signal generator and the injector is equal to that of between the signal receiver and the injector.

6. The sealant filling device according to claim 5, wherein a distance between the signal generator and an edge of the injector is 1.5-2 cm.

7. The sealant filling device according to claim 5, wherein a signal source of the signal generator is an infrared ray.

8. The sealant filling device according to claim 1, wherein the injector comprises a top cover, a packaging barrel and an injector head, the plurality of sealing holes are defined on the top cover, the injector head is mounted at a bottom of the packaging barrel, the sealant is capable of pouring into the packaging barrel from the sealing hole and pouring out from the injector head.

9. The sealant filling device according to claim 8, wherein the weight sensor is mounted under the packaging barrel.

10. A sealant filling device, comprising:

a sealant board having a base, a sealing cover, a plurality of sealing holes defined in the sealing cover; and a plurality of injectors clamped in the base, each of the plurality of injectors having a filling hole corresponding to the sealing hole;

wherein a spring is arranged between a top of the injector and the sealing cover for moving in control, while a volume of the sealant reaches a preset value, the spring is controlled to move and seal off the sealing hole to stop sealing.

11. The sealant filling device according to claim 10, wherein a eight sensor is arranged on a bottom of the injector for measuring a sealant weight of the injector.

12. The sealant filling device according to claim 10, wherein a height sensor is located at two sides of the injector for measuring if a height of the sealant reaches a highest preset value or not.

13. The sealant filling device according to claim 11, wherein the injector comprising a controller IC and a motor, the controller IC is electrically connected with the weight sensor and the motor, the motor is also electrically connected with the spring, the controller IC is provided for receiving a detection signal form the weight sensor and controlling the motor to drive the spring to move according to a compared result between the sealant weight and a standard value of the detection signal.

14. The sealant filling device according to claim 12, wherein the controller IC is electrically connected with the height sensor and the motor, the motor is electrically connected with the spring, the controller IC is provided for receiving a detection signal from the height sensor and controlling the motor to drive the spring to move according to a compared result between the height of sealant and the highest preset value of the detection signal.

15. The sealant filling device according to claim 14, wherein the height sensor comprises a signal generator and a signal receiver in a same horizontal line, while the height of the injected sealant reaches the preset value, the signal receiver do not receive the signal from the signal generator, and the signal receiver sends a broken signal to the controller IC to drive the spring to move and seal off the sealing hole by controlling the motor.

16. The sealant filling device according to claim 15, the signal generator and the signal receiver are separated placed on the two sides of the injector, a distance between the signal generator and the injector is equal to that of between the signal receiver and the injector.

17. The sealant filling device according to claim 16, wherein a distance between the signal generator and an edge of the injector is 1.5-2 cm.

18. The sealant filling device according to claim 10, wherein the injector comprises a top cover, a packaging barrel and an injector head, the plurality of sealing holes are defined on the top cover, the injector head is mounted at bottom of the packaging barrel, the sealant is capable of pouring into the packaging barrel from the sealing hole and pouring out from the injector head.

19. The sealant filling device according to claim 18, wherein the weight sensor is mounted under the packaging barrel.

* * * * *